US007261621B2

(12) United States Patent
Moon et al.

(10) Patent No.: US 7,261,621 B2
(45) Date of Patent: Aug. 28, 2007

(54) PAD CONDITIONER FOR CHEMICAL MECHANICAL POLISHING APPARATUS

(75) Inventors: Sung-Taok Moon, Suwon-si (KR); Dong-Jun Lee, Seoul (KR); Jae-Hyun So, Seoul (KR); Kyoung-Moon Kang, Gwangmyeong-si (KR); Bong-Su Ahn, Seoul (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 0 days.

(21) Appl. No.: 11/368,704

(22) Filed: Mar. 7, 2006

(65) Prior Publication Data

US 2006/0199482 A1 Sep. 7, 2006

(30) Foreign Application Priority Data

Mar. 7, 2005 (KR) ..... 10-2005-0018785

(51) Int. Cl.
*B24B 19/00* (2006.01)
*B24B 21/18* (2006.01)

(52) U.S. Cl. ..... 451/287; 451/443; 451/529

(58) Field of Classification Search ..... 451/56, 451/443, 548, 285, 287, 288, 527, 534, 529
See application file for complete search history.

(56) References Cited

U.S. PATENT DOCUMENTS 2,309,016 A * 1/1943 Ryan ..... 451/548
5,389,032 A * 2/1995 Beardsley ..... 451/359
5,503,592 A * 4/1996 Neumann ..... 451/278
5,951,380 A * 9/1999 Kim ..... 451/65
6,179,695 B1 * 1/2001 Takahashi et al. ..... 451/287
6,248,006 B1 * 6/2001 Mukhopadhyay et al. .. 451/285
6,309,282 B1 * 10/2001 Wright et al. ..... 451/41
6,386,956 B1 * 5/2002 Sato et al. ..... 451/57
6,419,574 B1 * 7/2002 Takahashi et al. ..... 451/548
6,659,846 B2 * 12/2003 Misra et al. ..... 451/41
6,905,398 B2 * 6/2005 Jeong ..... 451/57
7,004,823 B2 * 2/2006 Kisboll et al. ..... 451/57
7,052,371 B2 * 5/2006 Benner ..... 451/36
2004/0137834 A1 * 7/2004 Webb et al. ..... 451/526
2006/0089095 A1 * 4/2006 Swisher et al. ..... 451/533

FOREIGN PATENT DOCUMENTS

JP 2002-337050 11/2002
JP 2004-130475 4/2004
KR 1999-0081117 11/1999

* cited by examiner

*Primary Examiner*—Eileen P. Morgan
(74) *Attorney, Agent, or Firm*—Harness, Dickey & Pierce, P.L.C.

(57) ABSTRACT

A pad conditioner may include a surface having a first region including a portion having relatively irregular shaped and friable polishing particles, and a second region including a portion having relatively regular shaped and tough polishing particles. The relatively regular shaped and tough polishing particles may be provided on the edge portion of the surface and the relatively irregular shaped and friable polishing particles may be provided on the center portion of the surface.

23 Claims, 6 Drawing Sheets

PAD CONDITIONER FOR CHEMICAL MECHANICAL POLISHING APPARATUS

PRIORITY STATEMENT

This U.S. non-provisional application claims priority under 35 U.S.C. §119 to Korean Patent Application No. 2005-18785 filed on Mar. 7, 2005, the contents of which are incorporated herein by reference.

BACKGROUND OF THE INVENTION

1. Field of the Invention

Example embodiments of the present invention relate to a pad conditioner for a chemical mechanical polishing (CMP) apparatus, and more particularly, to a pad conditioner that may improve performance of a polishing pad for a CMP polishing apparatus.

2. Description of the Related Art

The manufacture of a semiconductor wafer may involve a CMP process. The CMP process may cause a scratch and/or some other defect in the wafer. For example, the CMP process may involve polishing a wafer using a polishing pad. Stress and/or impact may be applied to surfaces of the wafer and/or the polishing pad during the CMP process.

In a conventional CMP process, a wafer may be polished with a polishing pad and slurry may be supplied to the wafer. The slurry, by-products of the polishing, and/or a variety of foreign substances may be deposited on the surface of the polishing pad. Such deposits may cause degradation in a polishing rate, for example. Accordingly, a pad conditioner may be implemented to reduce a degradation in polishing performance. By way of example only, the pad conditioner may include particles of diamond and/or artificial diamond.

FIG. 1 is a plan view of a conventional pad conditioner 10.

Referring to FIG. 1, the pad conditioner 10 may have a surface supporting a polishing particle layer 12. The polishing particle layer 12 may include polishing particles adhered to the pad conditioner 10. The polishing particles may be artificial diamond particles, for example. The polishing particle layer 12 may be a mixture of various types of artificial diamond particles, as shown in Table 1 below.

| | Sample 1 (%) | Sample 2 (%) |
|---|---|---|
| Erect Type | 15.1 | 18.9 |
| Recumbent Type | 37.5 | 34.0 |
| Partially-Crushed Type | 32.8 | 32.7 |
| Irregular Type | 11.8 | 11.2 |
| Two-Particle Type | 2.8 | 3.2 |
| Total | 100.0 | 100.0 |

Scratches and/or other defects generated during the CMP process may be caused by various factors, such as particles contained in the slurry, foreign substances, material characteristics and/or surface state of the polishing pad, and/or the artificial diamond particles being crushed and/or becoming detached from the pad conditioner. For example, the artificial diamond particles that may be crushed and/or detached from the pad conditioner may become interposed between the surfaces of the wafer and the polishing pad, possibly causing scratches and/or defects in the wafer.

As compared to the recumbent, the partially-crushed and the two-particle types of artificial diamond particles, the erect and the irregular types of artificial diamond particles may provide superior conditioning performance. However, the partially-crushed and the irregular types of artificial diamond particles may be more susceptible to being crushed, and the two-particle type of artificial diamond particles may be more susceptible to becoming detached from the pad conditioner. As can be appreciated from Table 1, the types of particles that may provide inferior conditioning performance (e.g., the recumbent, the partially-crushed and the two-particle types) and/or possibly cause wafer defects (e.g., the partially-crushed, the irregular and the two-particle types) may constitute a substantial portion of the particles in the polishing particle layer 12.

Various attempts have been implemented to improve the pad conditioner and associated polishing characteristics. In one example, a pad conditioner may include a first polishing particle layer having relatively small diamond particles fixed thereto and a second polishing particle layer having relatively large diamond particles fixed thereto. The first and the second polishing particle layers may form concentric circles. In another example, a pad conditioner may include a stepped surface having an upper portion and a lower portion. The same-sized artificial diamond particles may be adhered to the upper and the lower portions.

SUMMARY

According to an example, non-limiting embodiment, a pad conditioner may include a body having a surface with a first region and a second region. The first region may including a first portion having relatively-irregular shaped polishing particles. The second region may include a second portion having relatively-regular shaped polishing particles.

According to another example, non-limiting embodiment, a chemical mechanical polishing apparatus may include a rotatable platen. A polishing pad may be disposed on the platen. A rotatable wafer carrier may be provided to support a wafer. A nozzle may supply slurry onto the polishing pad. A pad conditioner may have a surface with a first region and a second region. The first region may include a first portion having relatively irregular shaped and friable diamond particles. The second region may include a second portion having relatively regular shaped and tough diamond particles. A rotational pivot having an arm may support the pad conditioner.

According to another example embodiment, a pad conditioner may include a body having a surface with a first region and a second region. Polishing particles may be provided on the first and the second regions. The polishing particles on the second region may be more regular shaped than the polishing particles on the first region.

BRIEF DESCRIPTION OF THE DRAWINGS

Example, non-limiting embodiments of the present invention will be readily understood with reference to the following detailed description thereof provided in conjunction with the accompanying drawings, wherein like reference numerals designate like structural elements.

DETAILED DESCRIPTION OF EXAMPLE, NON-LIMITING EMBODIMENTS

Example, non-limiting embodiments of the present invention will be described with reference to the accompanying drawings. However, the present invention is not limited to the example embodiments illustrated herein. Rather, the disclosed embodiments are provided to facilitate understanding of the scope and spirit of the present invention. The principles and features of this invention may be employed in varied and numerous embodiments without departing from the scope of the invention.

Well-known structures and processes are not described or illustrated in detail to avoid obscuring the present invention.

An element is considered as being mounted (or provided) "on" another element when mounted (or provided) either directly on the referenced element or mounted (or provided) on other elements overlaying the referenced element. Throughout this disclosure, terms such as "top," "bottom," "above," and "below" are used for convenience in describing various elements as shown in the figures. These terms do not, however, require that the structure be maintained in any particular orientation.

Figure 1:
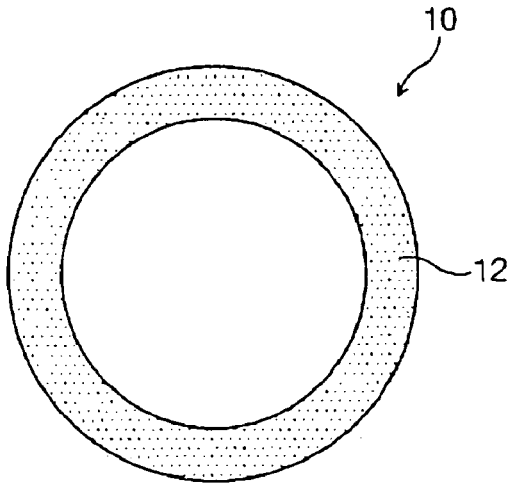
Fig. 1 (Conventional Art)
FIG. 1 is a plan view of a surface of a conventional pad conditioner.
Figure 2:
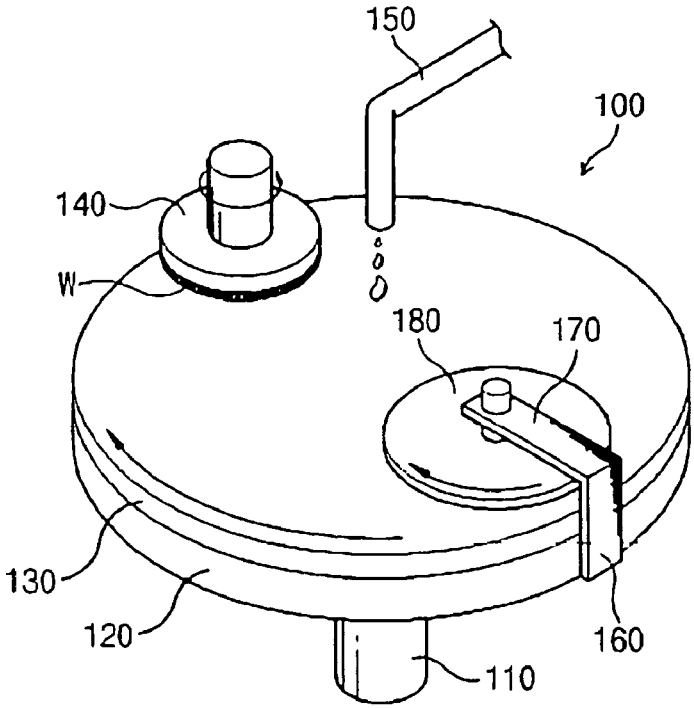
FIG. 2 is a perspective view of a CMP apparatus that may implement a pad conditioner according to an example embodiment of the present invention.

FIG. 2 is a perspective view of a CMP apparatus that may implement a pad conditioner according to an example embodiment of the present invention.

Referring to FIG. 2, a CMP apparatus 100 may include a pivot 110, a platen 120, a polishing pad 130, a wafer carrier 140, a slurry supply nozzle 150, a pivot 160, an arm 170, and a pad conditioner 180. The platen 120, which may be a rotatable table, may be connected on the pivot 110. The polishing pad 130 may be fabricated from urethane, for example. In alternative embodiments, the polishing pad 130 may be fabricated from materials (other than urethane) that are well known in this art. The polishing pad 130 may be disposed on the platen 120. The wafer carrier 140 may be rotatably installed above the polishing pad 130. By way of example only, the wafer carrier 140 may be located at an eccentric position from the center of the polishing pad 130. The wafer carrier 140 may be a circular plate. The wafer carrier 140 may have a smaller diameter than the polishing pad 130. The wafer carrier 140 may support a wafer W. During a wafer planarization process, the wafer W (which may be rotationally driven by the wafer carrier 140) may contact the polishing pad 130 (which may be rotationally driven by the pivot 110), and slurry may be supplied from the slurry supply nozzle 150 to the polishing pad 130.

As a result of the CMP process, the surface of the polishing pad 130 may become degraded (e.g., slippery), which may reduce a wafer polishing rate, a wafer polishing accuracy and/or a wafer polishing efficiency. Accordingly, the polishing pad 130 may be conditioned by the pad conditioner 180 to maintain the surface roughness of the polishing pad 130, as desired. The pad conditioner 180 may be rotatably installed on the arm 170. The arm 170 may extend from the pivot 160, which may be located around the periphery of the platen 120. The pad conditioner 180 may condition the polishing pad 130 (e.g., to restore and/or maintain the surface roughness of the polishing pad 130) when the wafer W is being polished, or when the wafer W is not being polished. By way of example only, the pad conditioner 180 may include a body (such as a metal disk), and polishing particles may be adhered to the body through an adhesive layer, such as an Ni adhesive layer. In alternative embodiments, the body may have a shape other than a disk shape, the body may be fabricated from a material other than metal, and the polishing particles may be adhered by an adhesive layer other than an Ni adhesive layer.

Figure 3:
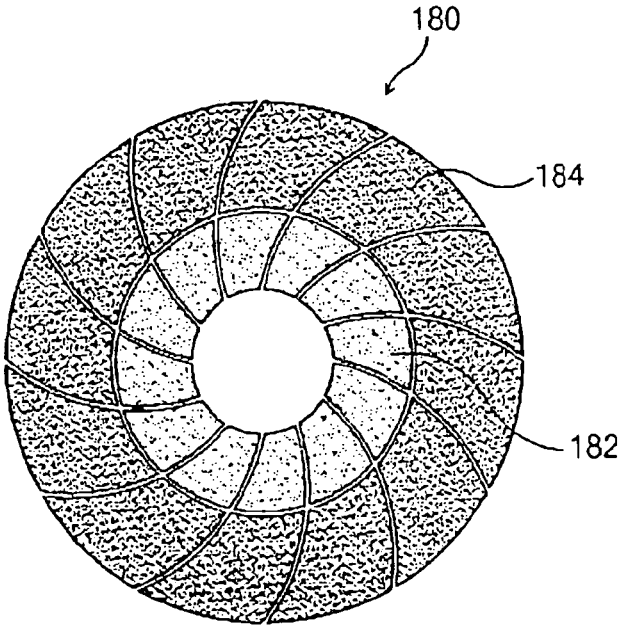
FIG. 3 is a plan view of a surface of a pad conditioner according to an example embodiment of the present invention.

FIG. 3 is a plan view of a surface of a pad conditioner according to an example embodiment of the present invention.

Referring to FIG. 3, the surface of the pad conditioner 180 may include a first region 182 and a second region 184. The first region 182 may occupy a center portion of the surface of the pad conditioner 180, and the second region 184 may surround the first region 182 and occupy an edge portion of the surface of the pad conditioner 180. By way of example only, the center and the edge portions may form concentric circles. Polishing particles, such as artificial diamond particles (for example), may be provided on each of the regions 182 and 184. Here, the type and/or toughness of the diamond particles may vary as per region. For example, relatively irregular and friable artificial diamond particles may be provided on the first region 182, and relatively regular and tough artificial diamond particles may be provided on the second region 184.

As a general matter, when a pad conditioner implements more irregular diamond particles (which may be susceptible to the crush and/or detachment phenomena), the likelihood of wafer defects may increase. In an effort to avoid such defects, the pad conditioner may implement classified artificial diamond particles (instead of irregular diamond particles). As compared to irregular diamond particles, classified diamond particles may have a more uniform size and shape.

Figure 4:
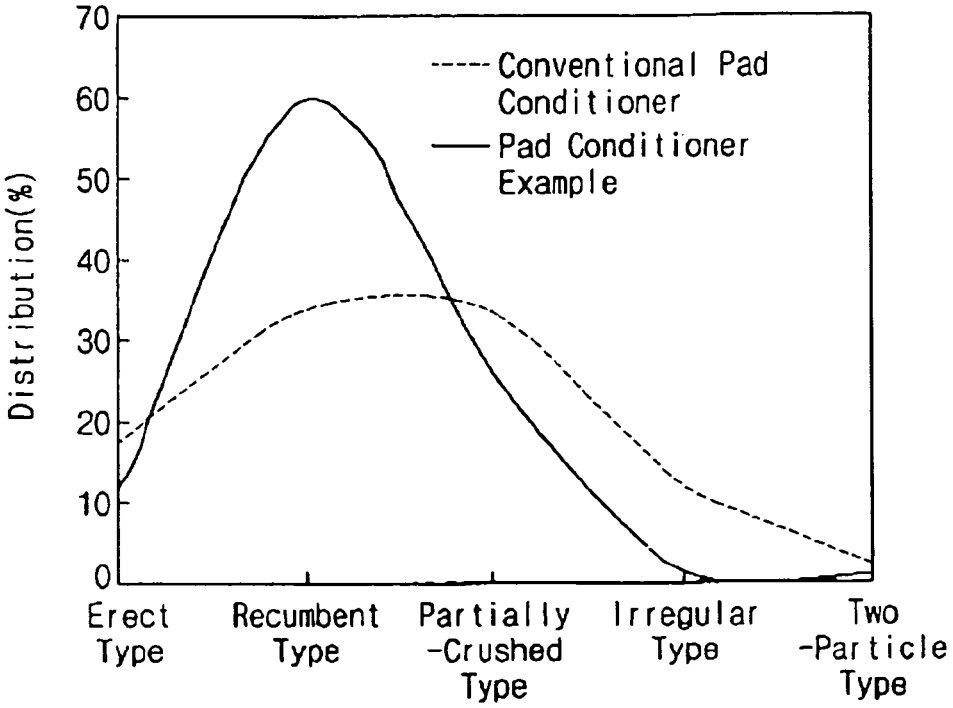
FIG. 4 is a graph comparing a pad conditioner according to an example embodiment of the present invention to a conventional pad conditioner.

FIG. 4 is a graph comparing the relative amounts of constituent particle types of a pad conditioner according to an example embodiment of the present invention (shown in solid line) to the relative amounts of constituent particle types of a conventional pad conditioner (shown in phantom line).

The partially-crushed type particles, the irregular type particles, and the two-particle type particles may be more easily detached and/or crushed than the erect type particles and the recumbent type particles. As such, the crush and/or detachment of particles may be reduced by implementing more classified particles, such as the erect type particles and the recumbent type particles (for example). Thus, the pad conditioner according to the example embodiment may include more classified particles and therefore may more effectively avoid a decrease in the pad conditioning effect than the conventional pad conditioner.

However, when compared to the conventional pad conditioner, a pad conditioner including more classified artificial diamond particles may cause a reduced polishing rate and/or more wafer defects, as shown in Table 2 below.

| Types of Pad Conditioners | Polishing Rate (Å/min) | Number of Defects | Number of Scratches |
|---|---|---|---|
| Conventional Pad Conditioner Using Unclassified Particles | 2,900 | 140 | 2 |
| Pad Conditioner Using Classified Particles | 2,300 | 180 | 28 |

In a pad conditioner implementing more classified artificial diamond particles, the particles are liable to become recumbent. The recumbent type particles may not provide a sufficient conditioning effect of the polishing pad and/or may not maintain the roughness of the polishing pad at a desired level. Slurry residues and/or foreign substance may not be efficiently removed, which may reduce the wafer polishing rate and/or cause more wafer defects.

To avoid a degradation in the polishing rate (which may occur due to the increased amount of classified particles) and to avoid the crush and detachment of the particles, the pad conditioner may include both classified particles and unclassified particles.

For example, and referring back to FIG. 3, the pad conditioner 180 may include unclassified artificial diamond particles in the first region 182, and classified artificial diamond particles in the second region 184. The classified artificial diamond particles of relatively more uniform size and type may be adhered to the second region 184, which may receive the highest pressure and/or stress during the CMP process, thereby reducing the crush and/or detachment of the artificial diamond particles. The unclassified artificial diamond particles of relatively less uniform size and type may be adhered to the first region 182, which may maintain the roughness of the polishing pad 130 at a desired level.

Figure 5:
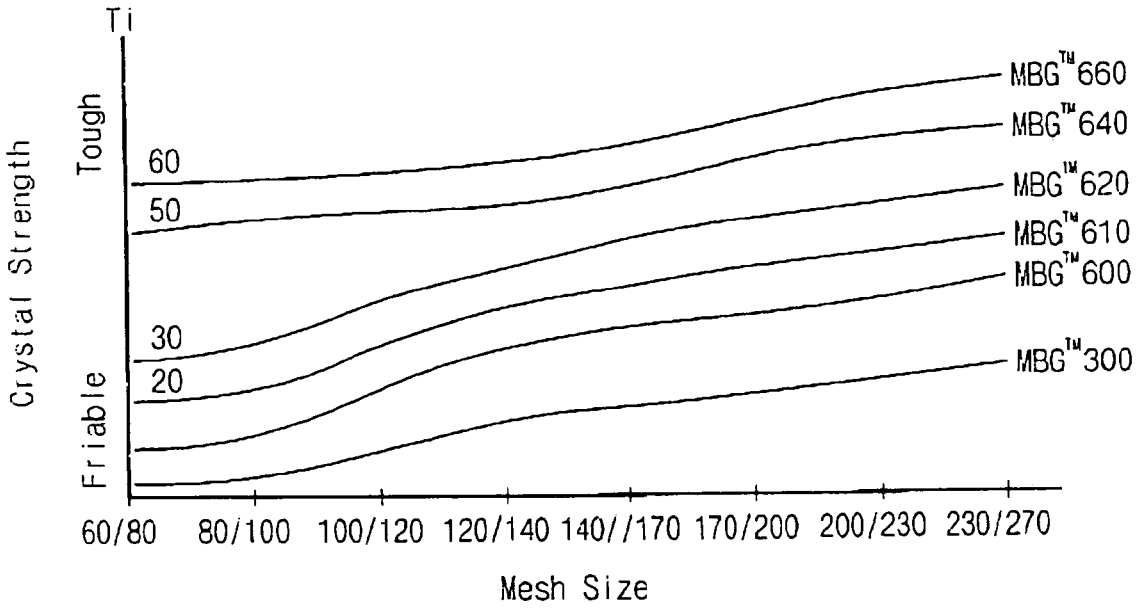
FIG. 5 is a graph of the relationship between a toughness index and a mesh size of artificial diamond particles.

The classified artificial diamond particles (e.g., MBG™ 660) may have a relatively uniform shape (e.g., cubo-octahedral morphology) and a toughness index (Ti) of 60 or more and may be adhered to the second region 184. Also, the unclassified artificial diamond particles (e.g., the conventional irregular artificial diamond particles) may have relatively non-uniform shapes and a toughness index (Ti) of below 60 and may be adhered to the first region 182. The toughness index Ti may represent the strength of the diamond particle, as shown in FIG. 5. The toughness index Ti may be measured as follows. Diamond particles of an average initial size (the "input amount") and steel balls may be placed into a capsule and then the capsule may be shaken. Thereafter, particles of the average initial size (the "remaining amount") and a smaller particle size are sorted, and the toughness index Ti is calculated using the sorting results and Equation 1 below.

$$(\text{Remaining Amount}/\text{Input Amount})\times 100 \quad (1)$$

The MBG™ 660 may be greater in Ti than the MBG™ 640. That is, the remaining amount of the MBG™ 660 may be greater than that of the MBG™ 640.

Figure 6:
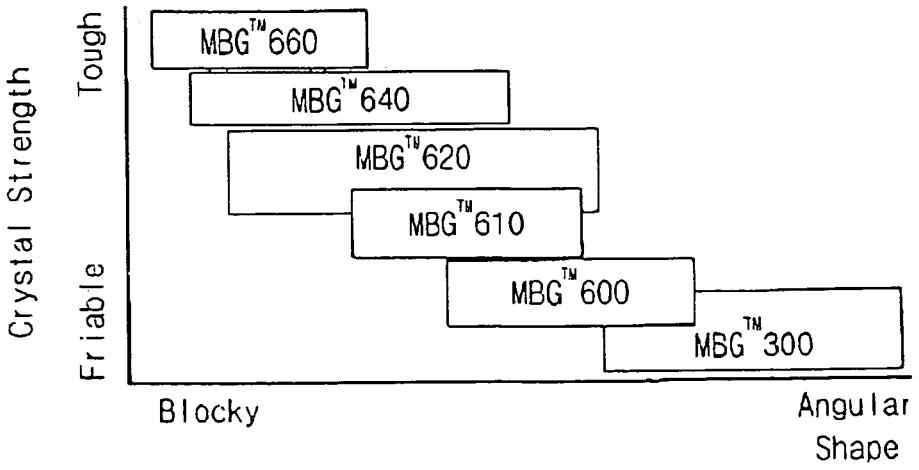
FIG. 6 is a graph of the relationship between a toughness index and the shape of artificial diamond particles.

FIG. 6 is a graph of the relationship between the toughness index and the shape of artificial diamond particles.

Referring to FIG. 6, the MBG™ 660 may be tougher than the MBG™ 640. That is, the MBG™ 640 may be more friable than the MBG™ 660.

Figure 7:
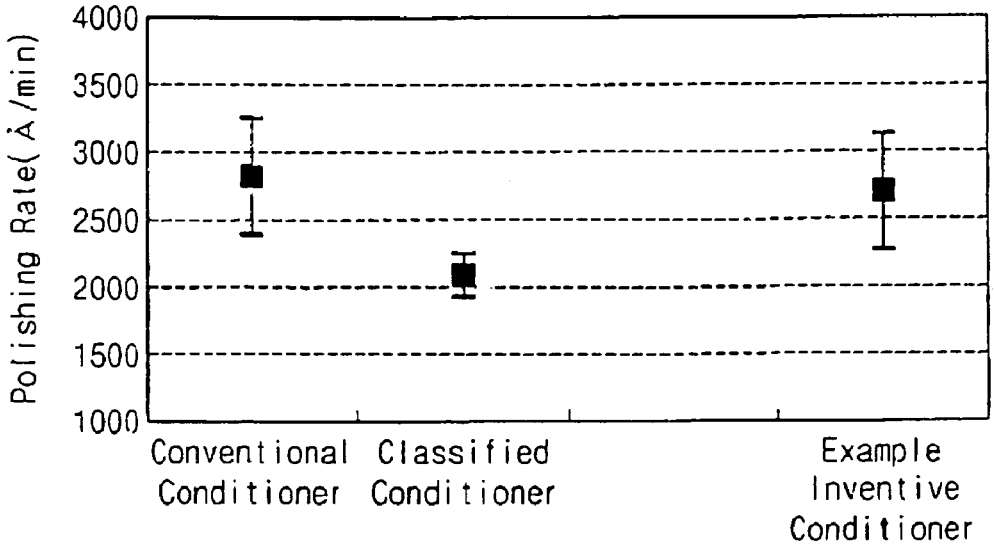
FIG. 7 is a graph comparing a wafer polishing rate that may result from implementing a pad conditioner according to an example embodiment of the present invention to wafer polishing rates that may result from implementing other pad conditioners.
Figure 8:
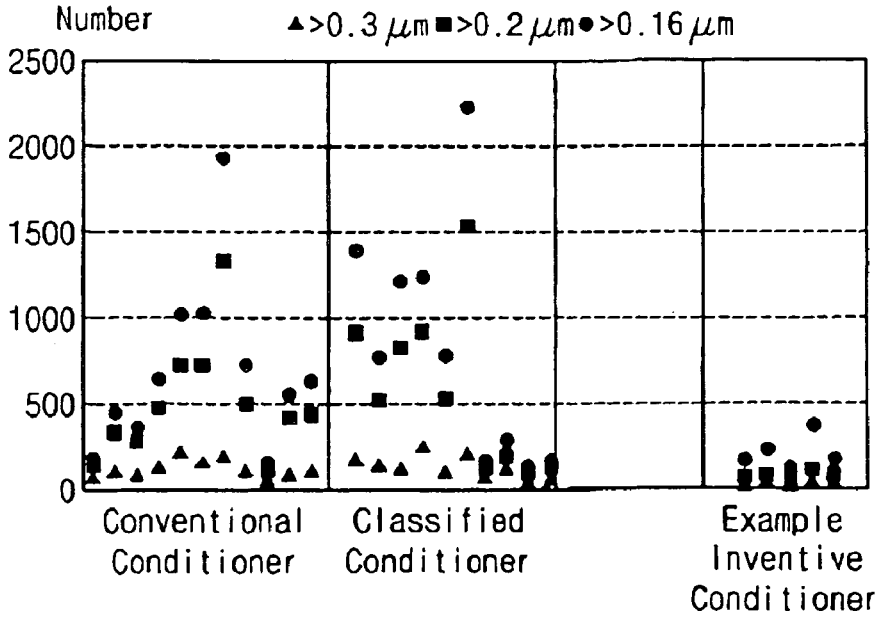
FIG. 8 is a graph comparing wafer defects that may result from implementing a pad conditioner according to an example embodiment of the present invention to wafer defects that may result from implementing other pad conditioners.

FIG. 7 is a graph comparing a wafer polishing rate that may result from implementing a pad conditioner according to an example embodiment of the present invention to wafer polishing rates that may result from implementing other pad conditioners. FIG. 8 is a graph comparing wafer defects that may result from implementing a pad conditioner according to an example embodiment of the present invention to wafer defects that may result from implementing other pad conditioners.

Referring to FIGS. 7 and 8, the pad conditioner including the uniform-sized artificial diamond particles through the classification process (the "classified pad conditioner") may provide an inferior wafer polishing rate as compared to the convention pad conditioner. Also, the number of wafer defects observed when implementing the classified pad conditioner may be similar to or slightly larger than that of the conventional pad conditioner. However, the pad conditioner that may include the classified particles and the unclassified particles (the "example inventive pad conditioner") may result in fewer wafer defects than the conventional pad conditioner, and provide about the same wafer polishing rate as the conventional pad conditioner. This may be because the second region 184 (which may be more susceptible to the crush and/or detachment of the particles) may be constituted by relatively regular and tough classified artificial diamond particles, and because the first region 182 may be constituted by relatively irregular and friable artificial diamond particles, which may more effectively maintain the roughness of the polishing pad and remove foreign substance, for example. Accordingly, the example inventive pad conditioner 180 may provide improved performance in terms of wafer polishing rate and wafer defects.

Figure 9:
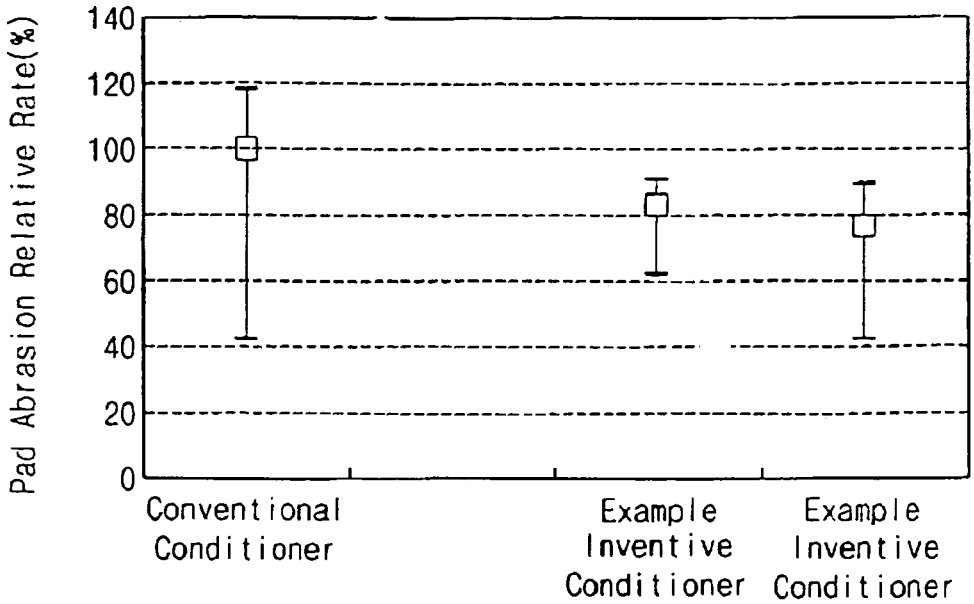
FIG. 9 is a graph comparing abrasion rates of polishing pads that may result from implementing pad conditioners according to example embodiments of the present invention to an abrasion rate of a polishing pad that may result from implementing a conventional pad conditioner.

FIG. 9 is a graph comparing abrasion rates of polishing pads that may result from implementing pad conditioners according to example embodiments of the present invention to an abrasion rate of a polishing pad that may result from implementing a conventional pad conditioner.

As can be seen from FIG. 9, the example inventive polishing pads may have a smaller abrasion rate than the conventional polishing pad. That is, the example inventive pad conditioners may extend the useful life of the polishing pad.

Figure 10:
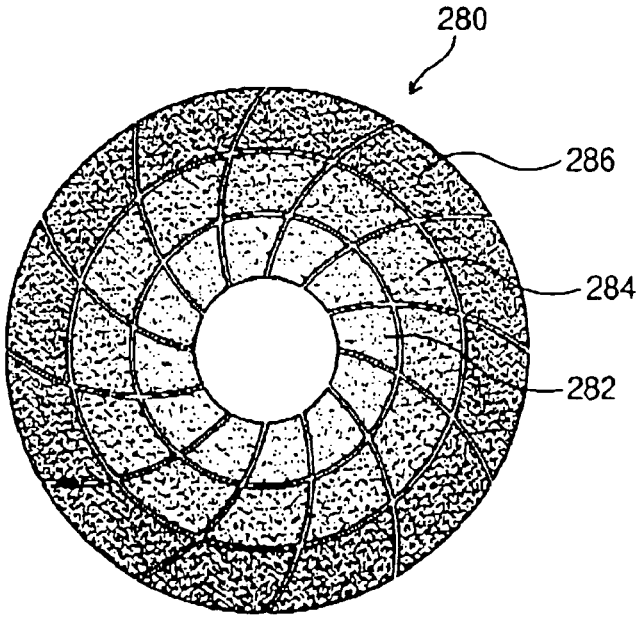
FIG. 10 is a plan view of a surface of a pad conditioner according to another example embodiment of the present invention.
Figure 11:
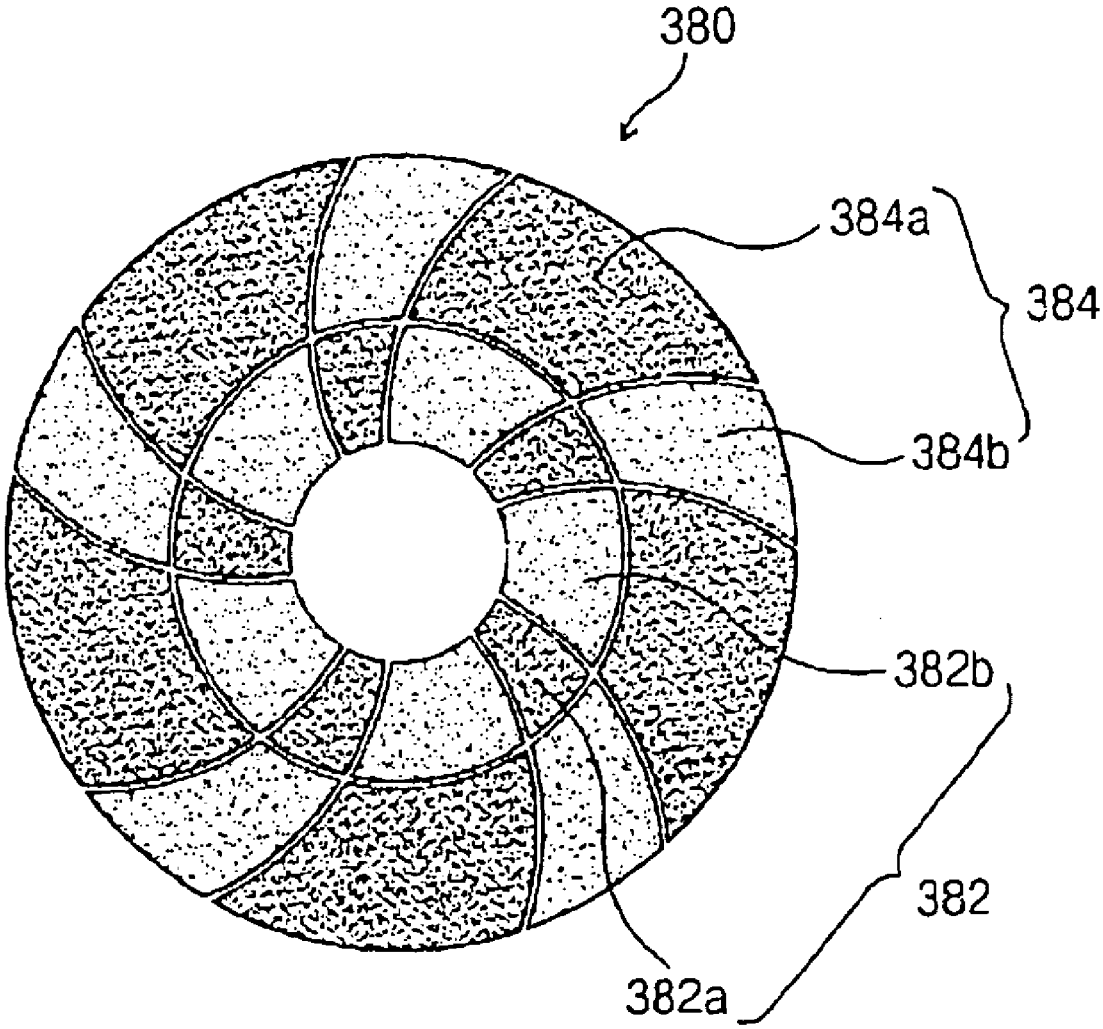
FIG. 11 is a plan view of a surface of a pad conditioner according to another example embodiment of the present invention.

FIG. 10 is a plan view of a surface of a pad conditioner according to anther example embodiment of the present invention, and FIG. 11 is a plan view of a surface of a pad conditioner according to another example embodiment of the present invention. A characteristic of the artificial diamond particles constituting a pad conditioner in these example embodiments may be similar to that of the previous example embodiments, only a structural difference in the pad conditioner will be described.

Referring to FIG. 10, a pad conditioner 280 may include a first region 282 having relatively irregular and friable artificial diamond particles adhered thereto, and a second region 286 having relatively regular and tough artificial diamond particles adhered thereto. The pad conditioner 280 may also include a third region 284 between the first region 282 and second region 286. The third region 284 may have artificial diamond particles having a relatively intermediate regularity and toughness. Accordingly, the performance characteristic of the pad conditioner 280 may be similar to that of the pad conditioner 180.

Referring to FIG. 11, a pad conditioner 380 may include a first region 382 and a second region 384. The first region 382 may include a strong particle portion 382*a* having relatively regular and tough artificial diamond particles adhered thereto, and a weak particle portion 382*b* having relatively irregular and friable artificial diamond particles adhered thereto. In the first region 382, the total area of the weak particle portion 382*b* may be larger than that of the strong particle portion 382*a*. Accordingly, the first region 382 may exhibit a characteristic more similar to that of the weak particle portion 382*b*. The second region 384 may include a strong particle portion 384*a* having relatively regular and tough artificial diamond particles adhered thereto, and a weak particle portion 384*b* having relatively irregular and friable artificial diamond particles adhered thereto. In the second region 384, the total area of the strong particle portion 384*a* may be larger than that of the weak particle portion 384*b*. Accordingly, the second region 384 may exhibit a characteristic more similar to that of the strong particle portion 384*a*. The pad conditioner 380 may have performance characteristics similar to that of the pad conditioner 180.

As described above, example embodiments of the present invention may enhance the pad conditioning effect by attaching relatively regular and tough artificial diamond particles to the edge portion of the surface of the polishing pad. Also, example embodiments of the present invention may improve the roughness of the polishing pad by attaching relatively irregular and friable artificial diamond particles to the center portion of the surface of the polishing pad. In this way, example embodiments of the present invention may improve a device yield by reducing wafer defects and extend the life of the polishing pad by reducing the abrasion rate of the polishing pad.

Although example, non-limiting embodiments of the present invention have been described, it will be understood that the invention is not limited to the details thereof. Various substitutions and/or modifications may become apparent to those of ordinary skill in the art. All such substitutions and/or modifications may still fall within the spirit and scope of the invention as defined in the appended claims. For example, the example embodiments may implement artificial (or natural) diamond particles. In alternative embodiments, the polishing particles may be fabricated from numerous other natural and/or artificial materials that are well known in this art.

What is claimed is:

1. A pad conditioner comprising:

a body having a surface with a first region and a second region;

the first region including a first portion and a second portion having polishing particles, the polishing particles of the second portion being more regular shaped than the polishing particles of the first portion, the first portion and second portion arranged in an alternating fashion in the circumferential direction and the second portion occupying a smaller area of the surface than the first portion; and the second region including a first portion having polishing particles that are more regular shaped than the polishing particles of the first portion of the first region.

2. The pad conditioner of claim 1, wherein the first region occupies a center portion of the surface.

3. The pad conditioner of claim 2, wherein the first region is ring-shaped.

4. The pad conditioner of claim 1, wherein the second region occupies an edge portion of the surface.

5. The pad conditioner of claim 4, wherein the second region is ring-shaped.

6. The pad conditioner of claim 1, wherein the second region includes a second portion having polishing particles that are more irregular shaped than the polishing particles of first portion of the second region, and the second portion of the second region occupies a smaller area of the surface than the first portion of the second region.

7. The pad conditioner of claim 1, further comprising a third region interposed between the first and the second regions, the third region including polishing particles being more regular shaped than the polishing particles provided in the first region and being more irregular shaped than the polishing particles provided in the second region.

8. The pad conditioner of claim 7, wherein the first region is ring-shaped and occupies a center portion of the surface, the second region is ring-shaped and occupies an edge portion of the surface, and the third region is ring-shaped and occupies a radially intermediate portion of the surface.

9. The pad conditioner of claim 1, wherein the more regular shaped polishing particles are tougher than the more irregular shaped polishing particles.

10. The pad conditioner of claim 9, wherein the more regular shaped polishing particles include artificial diamond particles having a toughness index of at least 60 Ti.

11. A chemical mechanical polishing apparatus, comprising:

a rotatable platen;

a polishing pad disposed on the platen;

a rotatable wafer carrier to support a wafer;

a nozzle to supply slurry onto the polishing pad;

a pad conditioner having a surface with a first region and a second region;

the first region including a first portion and a second portion having diamond particles, the diamond particles of the second portion being more regular shaped and tougher than the diamond particles of the first portion, the first portion and second portion arranged in an alternating fashion in the circumferential direction and the second portion occupying a smaller area of the surface than the first portion; and the second region including a first portion having diamond particles that are more regular shaped and tougher than the diamond particles of the first portion of the first region; and a rotational pivot having an arm supporting the pad conditioner.

12. The apparatus of claim 11, wherein the first region is ring-shaped and occupies a center portion of the surface, the second region is ring-shaped and occupies an edge portion of the surface, and the second region surrounds the first region.

13. The apparatus of claim 12, further comprising a third region interposed between the first and the second regions, the third region including diamond particles being more regular shaped and tougher than the diamond particles provided in the first region and being more irregular shaped and tougher than the diamond particles provided in the second region.

14. The apparatus of claim 11, wherein the more regular shaped and tougher diamond particles have a toughness index of at least 60 Ti.

15. The apparatus of claim 11, wherein the second region includes a second portion having diamond particles that are more irregular shaped and tougher than the diamond particles of the first portion of the second region.

16. A pad conditioner comprising:

a body having a surface with a first region and a second region, the first region having a first portion and a second portion, the first portion and second portion arranged in an alternating fashion in the circumferential direction and the second portion occupying a smaller area of the surface than the first portion; and polishing particles provided on the first and the second regions, the polishing particles on the surface in the second region being more regular shaped than the polishing particles on the surface in the first portion of the first region, and the polishing particles on the second portion of the first region being more regular shaped than the polishing particles on the first portion of the first region.

17. The pad conditioner of claim 16, wherein the polishing particles on the second region are tougher than the polishing particles on the first region.

18. The pad conditioner of claim 16, wherein the polishing particles are at least one of natural diamond and artificial diamond.

19. The pad conditioner of claim 16, wherein the second region surrounds a periphery of the first region.

20. The pad conditioner of claim 16, wherein the working surface has a circular shape.

21. A pad conditioner comprising:

a body having a surface with a first region and a second region;

the first region including a first portion having polishing particles provided on the surface;

the second region including a first portion and a second portion having polishing particles provided on the surface, the first portion and second portion arranged in an alternating fashion in the circumferential direction and the second portion occupying a smaller area of the surface than the first portion of the second region;

the first portion of the first region having polishing particles that are more irregular shaped than the polishing particles of the first portion of the second region; and the second portion of the second region having polishing particles that are more irregular shaped than the polishing particles of the first portion of the second region.

22. A chemical mechanical polishing apparatus, comprising:

a rotatable platen;

a polishing pad disposed on the platen;

a rotatable wafer carrier to support a wafer;

a nozzle to supply slurry onto the polishing pad;

a pad conditioner having a surface with a first region and a second region, the first region including a first portion having diamond particles provided on the surface, the second region including a first portion and a second portion having diamond particles provided on the surface, the first portion and second portion arranged in an alternating fashion in the circumferential direction and the second portion occupying a smaller area of the working surface than the first portion of the second region, the diamond particles of the first portion of the first region being more irregular shaped and tougher than the diamond particles of the first portion of the second region, and the diamond particles of the second portion of the second region being more irregular shaped and tougher than the diamond particles of the first portion of the second region; and a rotational pivot having an arm supporting the pad conditioner.

23. A pad conditioner comprising:

a body having a surface with a first region and a second region, the second region having a first portion and a second portion, the first portion and second portion arranged in an alternating fashion in the circumferential direction and the second portion occupying a smaller area of the surface than the first portion; and polishing particles provided on the surface in the first and the second regions;

the polishing particles on the surface in the first portion of the second region being more regular shaped than the polishing particles on the surface in the first region, the polishing particles of second portion of the second region being more irregular shaped than polishing particles of the first portion of the second region.

* * * * *

UNITED STATES PATENT AND TRADEMARK OFFICE

CERTIFICATE OF CORRECTION

PATENT NO. : 7,261,621 B2
APPLICATION NO. : 11/368704
DATED : August 28, 2007
INVENTOR(S) : Sung-Taek Moon et al.

It is certified that error appears in the above-identified patent and that said Letters Patent is hereby corrected as shown below:

On the title page item (75) should read: ~~Sung- Taok Moon~~ Sung- Taek Moon

Signed and Sealed this

Twentieth Day of November, 2007

JON W. DUDAS
*Director of the United States Patent and Trademark Office*